United States Patent [19]

Pitman et al.

[11] 4,424,044

[45] Jan. 3, 1984

[54] METHOD OF FABRICATING CATHODE ELECTRODES

[75] Inventors: Lawrence C. Pitman, Sudbury; Charles L. Toomey, Danvers, both of Mass.

[73] Assignee: Raytheon Company, Lexington, Mass.

[21] Appl. No.: 371,151

[22] Filed: Apr. 23, 1982

[51] Int. Cl.[3] ..... H01J 9/04

[52] U.S. Cl. ..... 445/35; 313/346 R; 427/77; 445/50; 445/51

[58] Field of Search ..... 445/35, 46, 50, 51; 427/77; 313/346 R

[56] References Cited

U.S. PATENT DOCUMENTS

| | | | |
|---|---|---|---|
| 2,339,392 | 1/1944 | Garner | 427/77 X |
| 2,654,045 | 9/1953 | Wright | 427/77 X |
| 2,879,432 | 3/1959 | Slivka | 313/346 R |
| 3,027,480 | 3/1962 | Tuinila et al. | 313/346 R X |
| 4,002,940 | 1/1977 | Ekkelboom et al. | 445/46 X |

*Primary Examiner*—Kenneth J. Ramsey

*Attorney, Agent, or Firm*—Philip J. McFarland; Joseph D. Pannone

[57] ABSTRACT

A method is disclosed to fabricate a cathode electrode for a continuous wave magnetron so that the resulting product is relatively free from random frequency modulation and frequency "pushing". The method generally comprises the steps of forming, from a slurry containing comminuted tungsten and thorium hydride, a cathode electrode of the desired shape and heat treating such cathode to remove all volatile elements and ultimately to form a cathode electrode made up of an eutectic mixture of tungsten and thorium particles of tungsten.

6 Claims, 1 Drawing Figure

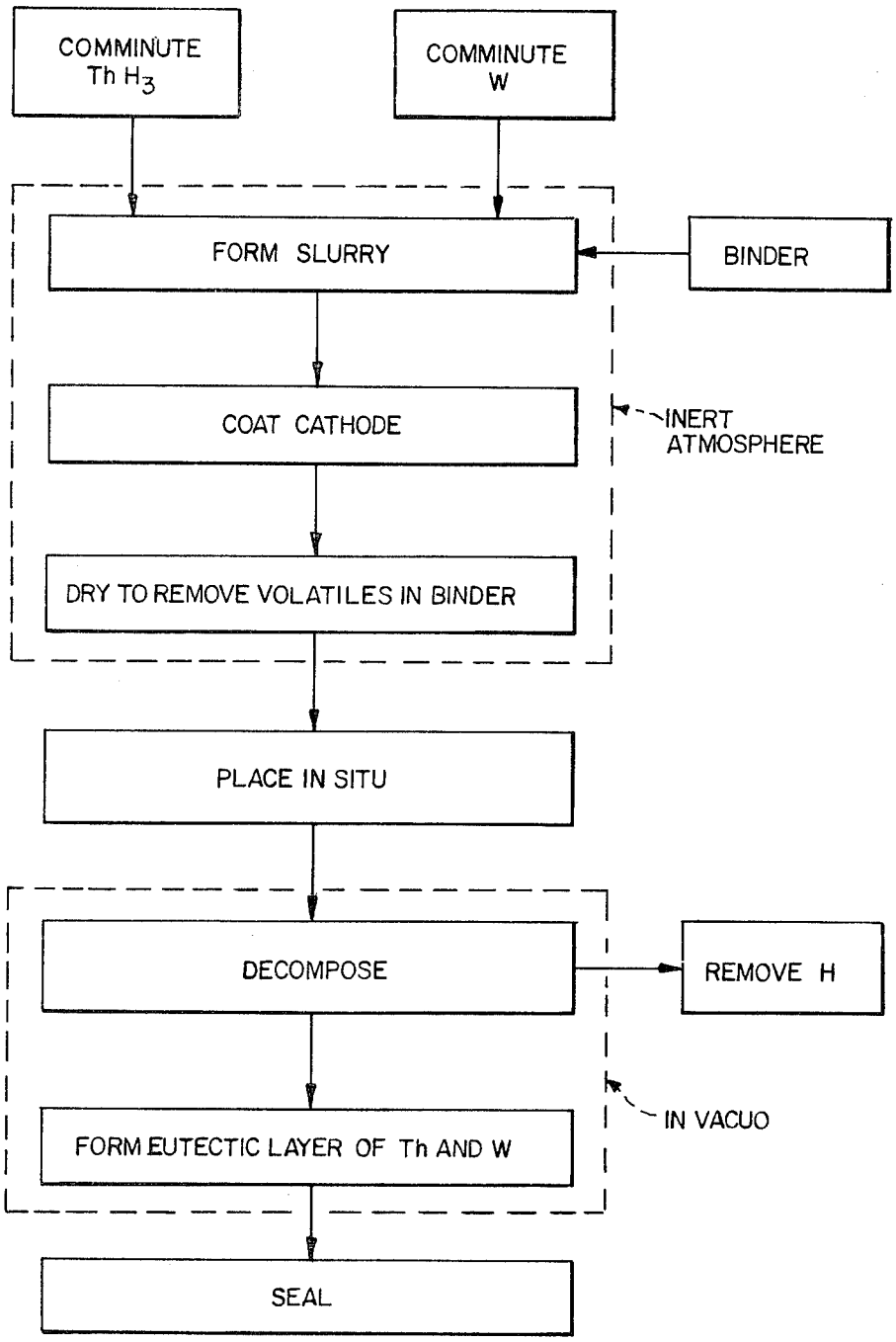
COMMINUTE Th $H_3$
COMMINUTE W
FORM SLURRY
BINDER
COAT CATHODE
INERT ATMOSPHERE
DRY TO REMOVE VOLATILES IN BINDER
PLACE IN SITU
DECOMPOSE
REMOVE H
IN VACUO
FORM EUTECTIC LAYER OF Th AND W
SEAL

METHOD OF FABRICATING CATHODE ELECTRODES

BACKGROUND OF THE INVENTION

This invention pertains generally to a method of making electron discharge devices and products therefrom, and particularly to a method of making an improved cathode electrode in a magnetron.

A known way to make a cathode electrode for a magnetron is shown and described in U.S. Pat. No. 3,027,480, assigned to the same assignee as this application. Briefly, according to the just-cited patent comminuted tungsten, thorium, tetraboride (or some other compound of thorium not containing oxygen) and rhenium are used to form an electron-emissive material that serves as the cathode electrode for a magnetron. In operation in a continuous wave (C.W.) radar, random frequency modulation (F.M.) due to released oxygen is almost eliminated and "frequency pushing" due to secondary emission is greatly reduced.

Unfortunately, however, it is extremely difficult to make a satisfactory cathode electrode according to the teaching of the cited reference with the result that yields of only 50% to 60% are the best that have been achieved. Further, even with initially satisfactory cathode electrodes, magnetrons made in accordance with the cited patent must be operated with precise control of the heater current to maintain the temperature of the cathode electrode at a temperature where frequency drift is insignificant. In field use, the required degree of control of the temperature of the cathode electrode may be achieved only by closely controlling the current in the filament within the cathode electrode; the required degree of control is, however, rarely achieved and maintained.

SUMMARY OF THE INVENTION

With the foregoing in mind, it is a primary object of this invention to provide an improved cathode electrode for a magnetron and to provide a method for making such an electrode.

Another object of this invention is to provide an improved electron-emissive material for the cathode electrode of a magnetron.

The foregoing and other objects of this invention are attained generally by forming, in the desired shape of a cathode electrode, an electron-emissive material in which particles of tungsten are coated with a eutectic mixture of thorium and tungsten, the thickness of such layer being controlled so that, in operation, the rate of diffusion of thorium to the surface of the cathode electrode is maintained at a rate such that a long life is provided and frequency drift is almost unnoticeable.

BRIEF DESCRIPTION OF THE DRAWINGS

For a more complete understanding of this invention, reference is now made to the drawings in which the single FIGURE is a diagram showing the contemplated method, it being deemed obvious that the product could appear to the eye to be identical with the cathode electrode shown in U.S. Pat. No. 3,027,480.

DESCRIPTION OF THE PREFERRED EMBODIMENT

Referring now to the FIGURE, it may be seen that comminuted thorium hydride ($ThH_3$) and tungsten (W) are added to a binder, such as xylene and polystyrene, in an inert atmosphere, say nitrogen, to form a slurry. The materials are dry, meaning that each contains less than three parts per million of water. The particle size of the thorium hydride and tungsten perferably is in the order of 2.6 microns. The proportion, by weight, of thorium hydride and tungsten added is preferably in a ratio of 2 to 98 percent, although the proportion may be varied to a ratio of 6 to 94 percent. The amount of the binder may be varied within wide limits so long as the slurry is relatively thick, meaning that it may be applied to a meshed surface (as shown in U.S. Pat. No. 3,027,480) or formed as a hollow cylinder while still in the inert atmosphere. After such application or forming, the coated assembly is dried in the inert atmosphere until the volatile parts of the binder have evaporated. To speed up the evaporation of the volatile parts of the binder, it is preferred that the coated assembly be heated to the boiling point of the selected binder.

The dried coated assembly (referred to now as a partially cured cathode electrode) is removed from the inert atmosphere and placed in situ (along with a filamentary heater of appropriate dimensions) in the magnetron in which it is to be used and such cathode-heater assembly is sealed in a conventional manner. A vacuum (substantially the same as that in a completed device) is then drawn, again in a conventional manner, so the partially cured cathode electrode is in vacuo within the magnetron. In passing, it is noted that, although the time elapsing between removal of the partially cured cathode electrode from the inert atmosphere until it is in vacuo is not critical, it is preferred that no more than two hours elapse to avoid contamination of the partially cured cathode electrode by moisture or oxygen from the air.

With the partially cured cathode electrode in situ under vacuum, an electric current is passed through the filamentary heater to bring the temperature of the partially cured cathode electrode to a temperature between 1750° centigrade and 1800° centigrade. Dissociation of the throium and hydrogen in the thorium hydride then occurs with the result that metallic thorium and hydrogen gas are formed. As the hydrogen gas evolves, it is removed through the vacuum pump (not shown). In addition, any residuum of the binder is dissociated into gaseous components which are similarly removed. The result then is that a mixture of particles of pure thorium and pure tungsten remains. The time taken for the foregoing reduction of the materials in the partially cured cathode electrode is not critical. It is preferred, however, that such time be in the order of at least four hours to ensure completion of the dissociation of all of the thorium hydride.

After completion of the foregoing step the electric current through the filamentary heater is increased to raise the temperature of the partially cured cathode electrode to approximately 1898° centigrade. The particles of thorium then diffuse through the particles of tungsten and the two metals interact to form a liquid eutectic mixture of thorium and tungsten on the surfaces of the particles of tungsten. The elapsed time for the step being described may be varied between three and six minutes.

After completion of the foregoing step, electric current is removed from the filamentary cathode and the still partially cured cathode electrode is cooled so that the liquid eutectic mixture solidifies to form a completely cured cathode electrode. The magnetron then may be completely sealed in a conventional manner.

It will be appreciated by those of skill in the art that parameters such as the mean diameter (and the variation about such mean) of the particles of the comminuted thorium and tungsten and the actual temperatures and elapsed time of treatment (especially of the final step) will affect the rate of diffusion of thorium to the surface of the cathode electrode during operation. Therefore, for any particular application, some adjustments may be required.

Having described a preferred embodiment of this invention, it will now be apparent to one of skill in the art that the principles disclosed may be applied to the fabrication of many different types of cathode electrodes. It is felt, therefore, that this invention should not be restricted to its disclosed embodiment, but rather should be limited only by the spirit and scope of the appended claims.

What is claimed is:

1. In the fabrication of an electron discharge device, the method of making a cathode electrode, such method comprising the steps of:

(a) mixing, in an inert atmosphere, comminuted tungsten and thorium hydride in a binder to produce a slurry;

(b) shaping the slurry in the form of the desired cathode electrode and drying to remove the volatiles in the binder to form a partially cured cathode electrode;

(c) placing the partially cured cathode electrode in situ in the electron discharge device;

(d) decomposing, in vacuo, the thorium hydride to form thorium and hydrogen and to drive off all remaining traces of the binder;

(e) heating, in vacuo, the partially cured cathode electrode to form, on particles of tungsten, an eutectic mixture of thorium and tungsten; and (f) sealing the electron discharge device to maintain a vacuum therein.

2. The method as in claim 1 wherein the mean size of the particles of comminuted thorium hydride and tungsten is approximately 2.6 microns.

3. The method as in claim 2 wherein the proportion, by weight, of the thorium hydride and tungsten varies, respectively, from 2 to 6 percent and 98 to 94 percent.

4. The method as in claim 3 wherein the binder is xylene and polystyrene.

5. The method as in claim 4 wherein decomposition of the thorium hydride is effected by heating the partially cured cathode electrode to a temperature between 1700° centigrade and 1780° centrigrade for a period of at least four hours.

6. The method as in claim 5 wherein the eutectic mixture is formed by heating the partially cured cathode electrode to a temperature of 1772° centigrade for a period of between three and six minutes.

* * * * *